United States Patent [19]

Goletski

[11] Patent Number: 4,489,981

[45] Date of Patent: Dec. 25, 1984

[54] WHEELCHAIR ADJUSTABLE ARM REST ASSEMBLY

[75] Inventor: Bert J. Goletski, Los Angeles, Calif.

[73] Assignee: Everest & Jennings, Inc., Camarillo, Calif.

[21] Appl. No.: 462,342

[22] Filed: Jan. 31, 1983

[51] Int. Cl.[3] ..... A47C 7/54

[52] U.S. Cl. ..... 297/411; 297/416; 297/417; 297/DIG. 4

[58] Field of Search ..... 297/411, 412, 416, 417, 297/DIG. 4

[56] References Cited

U.S. PATENT DOCUMENTS

| | | | |
|---|---|---|---|
| 3,198,575 | 8/1965 | Hawkins | 297/416 X |
| 3,853,372 | 12/1974 | Meyer | 297/417 |
| 3,993,351 | 11/1976 | Rodaway | 297/416 |
| 4,358,125 | 11/1982 | Charles | 297/DIG. 4 |

FOREIGN PATENT DOCUMENTS

| | | | |
|---|---|---|---|
| 3003219 | 8/1981 | Fed. Rep. of Germany | 297/411 |

*Primary Examiner*—Francis K. Zugel

*Attorney, Agent, or Firm*—Ralph B. Pastoriza

[57] ABSTRACT

Front and rear downwardly extending arm rest support tubes are received in correspondingly positioned front and rear vertical receiving tubes on the side of a wheelchair. A pin is arranged to project into registered openings in the front telescoping tubes so that an arm rest on the arm rest support tubes can be positioned at a selected height and locked in such adjusted position. A specially designed handle is arranged to retract the pin when urged forwardly, the handle being engaged by the web of a patient's hand between the thumb and forefinger, unlocking of the tubes permitting vertical adjustment. Release of the specially designed handle results in automatic biasing of the pin into registration with aligned openings in the front telescoping tubes.

2 Claims, 3 Drawing Figures

WHEELCHAIR ADJUSTABLE ARM REST ASSEMBLY

FIELD OF THE INVENTION

This invention relates generally to wheelchairs and more particularly to an improved vertically adjustable wheelchair arm rest and operating mechanism therefor.

BACKGROUND OF THE INVENTION

Various arrangements have been proposed and many are in present use today for varying the vertical height of the padded arm rest normally provided on either side of a wheelchair seat. A major problem with all such systems as have been proposed is the difficulty for the wheelchair patient himself or herself to effect the desired vertical adjustment. For example, where telescoping tubes are employed, a small button detent type structure is often utilized to lock the telescoping tubes in selected positions. No difficulty is normally encountered with properly positioning the arm rest at a selected position by a nurse or other attendant. On the other hand, it is often very difficult if not impossible for a wheelchair patient, particularly when use of his or her arms and hands is impaired, to negotiate the necessary action to release the telescoping tubes and thereby permit adjustment of the arm rests.

In U.S. Pat. No. 3,993,351 owned by the same assignee as the present invention, there is disclosed a vertically adjustable wheelchair arm rest wherein an oval shaped collar surrounds the front telescoping tubes and carries a pin projecting into registering openings to lock the tubes in a desired position. This collar presents a fairly large area front surface for engagement by a portion of a patient's body, the patient urging the collar rearwardly to thereby release the pin and permit adjustment of the arm rest.

While the foregoing structure to some extent solves problems associated with adjustable arm rests as described heretofore, for certain types of immobile patients, it is very difficult to move the collar in a rearward direction with the hand or arm of the patient on the same side as the arm rest to be adjusted. While the collar can easily be urged rearwardly by the patient's opposite hand or arm or even wrist stub, it is very difficult for the patient to thereafter move the arm rest with the adjacent arm or hand to a desired vertical position.

BRIEF DESCRIPTION OF THE PRESENT INVENTION

With the foregoing considerations in mind, the present invention contemplates a specially designed handle and pin arrangement for locking and releasing vertically adjustable arm rests for wheelchairs which overcomes some of the immediately and previously noted problems.

Briefly, in accord with the present invention, front and rear vertical receiving tubes are provided on the side of a wheelchair. Front and rear arm rest support tubes, in turn, are telescopically received in the vertical receiving tubes respectively, the front arm rest support tube having a series of vertically spaced holes in its front wall and the front vertical receiving tube having a single hole in its front wall positioned to be in successive registration with the series of vertically spaced holes as the arm rest support tubes are raised and lowered to adjust the height of the arm rest carried thereby. A spring biased pin means in front of the single hole includes a pin for movement through the single hole and into a registering hole to lock the telescoping tubes in a given position. The assembly is completed by the provision of a handle secured to the pin, the handle facing rearwardly and having a concave surface for engagement by the web of a patient's hand between the thumb and forefinger so that forward pushing of the handle by the patient can very easily be carried out and will retract the pin so that vertical adjustment of the arm rest by the patient using his other hand can be accomplished.

In other words, the design is such that the hand of a patient adjacent to the side arm rest to be adjusted can easily be used to release the arm rest, the same then being adjusted by the patient's other hand.

BRIEF DESCRIPTION OF THE DRAWINGS

A better understanding of this invention will be had by referring to a preferred embodiment as illustrated in the accompanying drawings in which.

DETAILED DESCRIPTION OF THE PREFERRED EMBODIMENT

Figure 1:
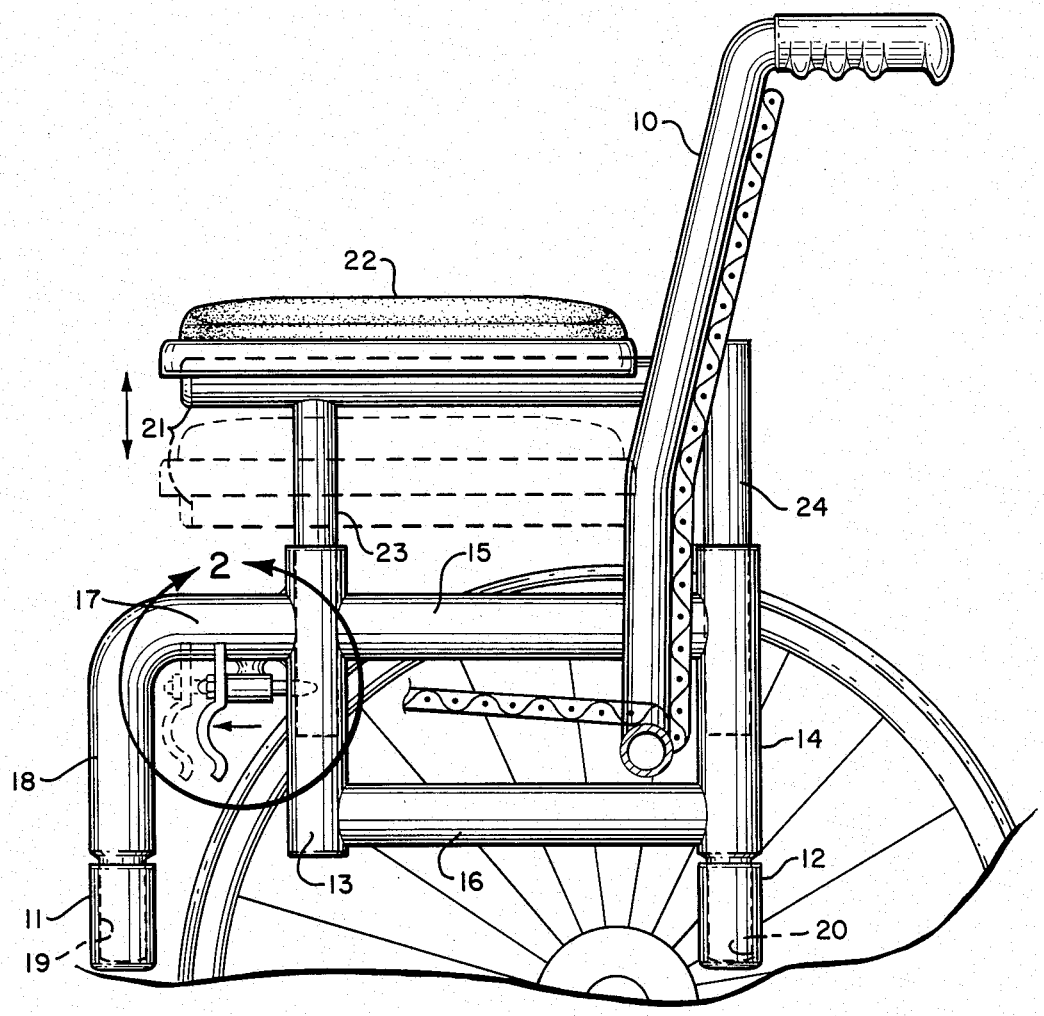
FIG. 1 is a fragmentary side elevational view partly in cross section of the right side of a wheelchair showing the adjustable arm rest assembly of this invention.

Referring to the upper right portion of FIG. 1 there is shown a wheelchair 10. Part of the frame for wheelchair 10 includes a front receiving socket 11 shown in the lower left portion of FIG. 1 and a rear receiving socket 12 for detachably supporting an arm rest assembly to the side of the chair.

As mentioned briefly heretofore, FIG. 1 shows the right side arm assembly for a wheelchair which includes a front vertical receiving tube 13, a rear vertical receiving tube 14, an upper horizontal tube 15 and a lower horizontal tube 16. Tubes 15 and 16 have their ends secured adjacent to the upper and lower ends of the vertical receiving tubes 13 and 14 as shown to define a rectangular frame assembly.

A front post tube has a horizontal portion 17 secured to and extending from the front vertical tube 13 in axial alignment with the upper horizontal tube 15. This front post also includes a vertical portion 18 extending downwardly to terminate in an end 19 receivable in the rear receiving socket 11 of the wheelchair. The lower end 20 of the rear vertical receiving tube 14, in turn, is receivable in the rear receiving socket 12 as shown so that the rectangular frame assembly is properly secured to the side of the wheelchair and yet can be removed by lifting the entire frame structure from the front and rear sockets 11 and 12.

As shown in the upper central portion of FIG. 1, the arm rest assembly includes an arm rest comprised of a horizontal tube 21 supporting an arm rest pad 22. A front arm rest support tube 23 and a rear arm rest support tube 24 extend downwardly from the arm rest, these tubes respectively being telescopically received in the front and rear vertical receiving tubes 13 and 14. It will be noted that by telescoping the front and rear arm rest support tubes 23 and 24 within the front and rear vertical receiving tubes 13 and 14, the vertical height of the arm rest relative to the wheelchair seat can be adjusted, all as indicated by the lowered phantom line position of the arm rest and the double headed arrow.

In order to lock the arm rest in a desired vertically adjusted position, there is provided a spring biased pin and handle structure enclosed within the circular arrow 2 of FIG. 1. This structure can best be described by referring now to the enlarged cross section of FIG. 2. As shown, the front arm rest support tube 23 includes a series of vertically spaced indexing holes 25 in its front wall. The front vertical receiving tube 13, in turn, includes under the horizontal portion 17 of the front post tube a single hole 26 in its forwardly facing wall positioned to be in successive registration with the series of indexing holes 25 when the front arm rest support tube 23 is telescoped within the front vertical receiving tube 13 to vary the height of the arm rest.

The spring biased pin means referred to in FIG. 1 is disposed in front of the single hole 26 and includes a cylindrical guide barrel 27 secured to the underside of the horizontal portion 17 of the front post as at 28. A locking pin 29 is horizontally slidable in the barrel 27 from a first position in which one end extends into the single hole 26 and one of the series of indexing holes 25 to lock the front arm rest support tube 23, to a second position free of the one of the series of indexing holes 25 to free the front arm support tube for vertical telescoping movement. This latter second position is depicted by the phantom line showing of the pin at 29' in FIG. 2.

Operation of the pin is accomplished by the provision of a downwardly extending operating handle 30 secured to the end of the pin opposite the one end received within the single hole 26. Handle 30 has a smooth, concavely curved surface 31 facing rearwardly or to the right as viewed in FIG. 2 in a position such that a patient in the wheelchair can easily engage the handle with the web portion of the hand between the thumb and forefinger to push the handle forwardly and thereby retract the pin 29 to its second position. A coiled spring 32 in the cylindrical barrel 27 serves to bias the pin to its first position so that upon release of the handle 30, the pin will seek at its first position and fall into the next successive hole in registration with the single hole 26.

Figure 3:
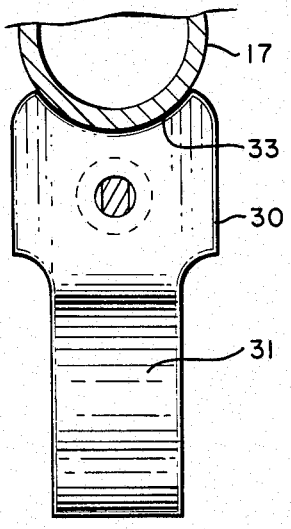

In the preferred embodiment of the invention, the upper end of the handle 30 is cradle shaped as indicated at 33 as best seen in FIG. 3 to engage the underside of the horizontal portion 17 of the front post. This underside of the front post thus functions as a stabilizing guide for horizontal movement of the pin by means of the handle between its first and second positions thereby minimizing the risk of binding.

It will be evident from the foregoing description that when it is desired to adjust the vertical level of the arm rest 21 shown in FIG. 1, a patient need only urge the handle 30 forwardly with his hand closest to the arm rest assembly involved. Since the right hand arm rest assembly is depicted in FIG. 1, the patient will engage the handle 30 with the web portion of his right hand between the thumb and forefinger and simply urge the structure forwardly to the phantom line position as described. With his other hand the patient can adjust the arm rest 21 to the desired height and then release the handle 30 thereby permitting the spring to return the pin to its first position which locks the arm rest in the adjusted position.

The arm rest on the left side is similarly constructed so that the patient can use his web portion between the thumb and forefinger of his left hand to urge the handle forwardly and thereby easily release the locked telescoping tubes and enable adjustment of the left side arm rest by using his right hand.

Figure 2:
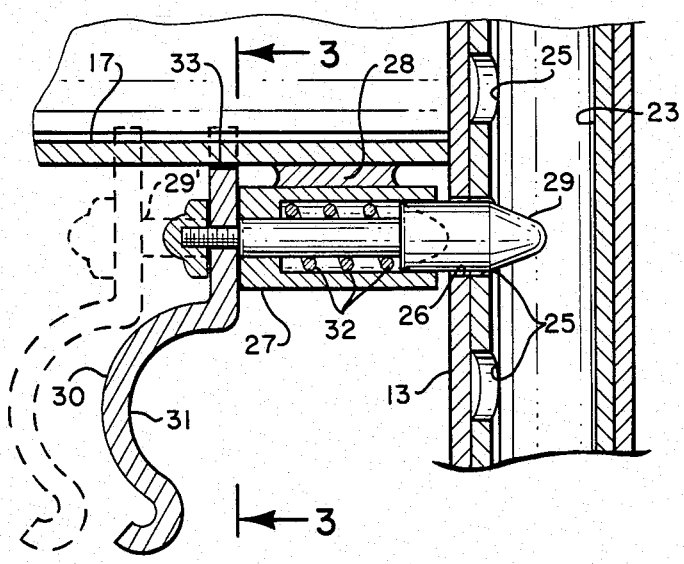
FIG. 2 is an enlarged fragmentary cross section of that portion of the apparatus of FIG. 1 enclosed within the circular arrow 2; and, FIG. 3 is a fragmentary cross section taken in the direction of the arrows 3—3 of FIG. 2.

It will be evident from the foregoing, that because of the fairly large smooth concave area of engagement for the handle 30 as described at 31 in FIGS. 2 and 3, even though a patient may have little dexterity with his hand, he can still urge forwardly the handle and thus the pin to unlock the telescoped tubes and permit adjustment of the arm rest.

I claim:

1. A wheelchair adjustable arm rest assembly including:

(a) front and rear vertical receiving tubes on a side of the wheelchair;

(b) an arm rest;

(c) front and rear arm rest support tubes telescopically receivable in said vertical receiving tubes respectively the front arm rest support tube having a series of vertically spaced holes in its front wall and the front vertical receiving tube having a single hole in its front wall positioned to be in successive registration with said series of vertically spaced holes as the arm rest support tubes are raised and lowered to adjust the height of the arm rest;

(d) spring biased pin means in front of said single hole including a pin for movement through the single hole and into a registering hole to lock the telescoping tubes in a given position;

(e) a front post having an horizontal portion extending from the front of the front vertical receiving tube above said single hole, thence turning downwardly into a vertical portion connecting to said wheelchair, said spring-biased pin means including a guide barrel secured to the underside of said horizontal portion of said front post, said pin being slidable in said guide barrel;

(f) a handle secured to said pin, said handle facing rearwardly and having a concave surface for engagement by the web of a patient's hand between the thumb and forefinger so that forward pushing of the handle by the patient retracts the pin so that vertical adjustment of the arm rest can be made;

and (g) a spring biasing said pin into said single hole so that when said handle is released, said pin is automatically biased into one of said series of holes when the same is in registration with said hole; the upper end of said handle defining a cradle engaging the underside of said horizontal portion of said front post to stabilize guiding movement of said pin in said barrel.

2. An adjustable arm rest assembly for wheelchairs wherein the wheelchairs include a front receiving socket and a rear receiving socket to detachably support the assembly, said assembly including, in combination:

(a) a front vertical receiving tube and a rear vertical receiving tube;

(b) an upper horizontal tube and a lower horizontal tube secured at their ends adjacent to the upper and lower ends of the vertical receiving tubes to define a rectangular frame assembly;

(c) a front post tube having a horizontal portion secured to and extending from said front vertical tube in axial alignment with said upper horizontal tube, and a vertical portion extending downwardly to terminate in an end receivable in the front receiving socket of the wheelchair, the lower end of the rear vertical receiving tube being receivable in said rear receiving socket of the wheelchair so that the rectangular frame assembly is secured to a side of the wheelchair;

(d) an arm rest;

(e) a front arm rest support tube and a rear arm rest support tube for supporting said arm rest, respectively telescopically received in the front and rear vertical receiving tubes, said front arm rest support tube having a series of vertically spaced indexing holes, the forwardly facing wall of said front vertical receiving tube under the horizontal portion of said front post tube having a single hole positioned to be in successive registration with said series of indexing holes when said front arm rest support tube is telescoped within said front vertical receiving tube to vary the height of said arm rest;

(f) a cylindrical guide barrel positioned in front of said single indexing hole and secured to the underside of said horizontal portion of said front post;

(g) a locking pin horizontally slidable in said barrel from a first position in which one end extends into said single hole and one of said series of indexing holes to lock said front arm rest support tube, to a second position free of said one of said series of indexing holes to free said front arm rest support tube for vertical telescoping movement;

(h) a downwardly extending operating handle secured to the end of said pin opposite said one end, said handle having a smooth concavely curved surface facing rearwardly in a position such that a patient in the wheelchair can easily engage the handle with the web portion of the hand between the thumb and forefinger to push the handle forwardly and thereby retract the pin to its second position; and (i) a spring in said barrel biasing the pin to its first position so that upon release of the handle, the pin will seek its first position and fall into the next successive hole in registration with said single hole the upper end of said handle above its securement point to said pin being cradle-shaped to engage the underside of said horizontal portion of said front post such that said underside functions as a stabilizing guide for horizontal movement of said pin between its first and second positions, whereby the risk of binding is minimized.

* * * * *